United States Patent [19]

Adams et al.

[11] 4,352,697

[45] Oct. 5, 1982

[54] METHOD OF HOT-FORMING METALS PRONE TO CRACK DURING ROLLING

[75] Inventors: Ronald D. Adams; E. Henry Chia, both of Carrollton, Ga.

[73] Assignee: Southwire Company, Carrollton, Ga.

[21] Appl. No.: 80,368

[22] Filed: Oct. 1, 1979

[51] Int. Cl.[3] ..... C22F 1/08

[52] U.S. Cl. ..... 148/2; 148/11.5 C; 164/76

[58] Field of Search ..... 148/2, 11.5 C, 12.7 C, 148/13.2, 32; 164/76, 417; 75/153

[56] References Cited

U.S. PATENT DOCUMENTS

| | | | |
|---|---|---|---|
| 2,666,721 | 1/1954 | Bechtold et al. | 148/2 |
| 3,315,349 | 4/1967 | Cofer | 164/76 |
| 3,317,994 | 5/1967 | Cofer et al. | 164/76 |
| 3,333,452 | 8/1967 | Sendzimir | 164/76 |
| 3,589,430 | 6/1971 | Barrow et al. | 164/76 |
| 3,710,436 | 1/1973 | Schoffmann | 164/76 |
| 3,729,973 | 5/1973 | Wykes | 164/76 |
| 3,942,582 | 3/1976 | Dompas et al. | 164/76 |
| 3,987,536 | 10/1976 | Figueres et al. | 164/76 X |
| 4,151,896 | 5/1979 | Nicoud et al. | 148/2 |

OTHER PUBLICATIONS

Dowsing, "New 3¼ M Production Line Upgrades Quality, Doubles Output for Delta Metal", *Metals and Materials,* Jun. 1975, pp. 19–23.

*Application Data Sheet*–"Standard Designations for Copper and Copper Alloys" CDA Inc., N.Y., N.Y., pp. 1, 3 and 18.

*Primary Examiner*—Peter K. Skiff

[57] ABSTRACT

A method of continuously casting a molten metal in a casting means to obtain a solidified cast bar at a hot-forming temperature, passing the cast metal at a hot-forming temperature from the casting means to a hot-forming means, and hot forming the cast bar into a wrought product by a two-stage reduction of its cross-sectional area while it is still at a hot-forming temperature, including, in the first stage, the step of forming a shell of finely distributed recrystallized grains in the surface layers of the cast bar by a selected small amount of deformation of the cast bar in its as-cast condition prior to the second stage in which substantial reduction of its cross-sectional area forms the wrought product. The shell of fine grains formed on the cast bar during the first stage of deformation permits substantial reduction of the cross-sectional area of the cast bar during the second stage of deformation without the cast bar cracking, even when the cast bar has a high impurity content.

7 Claims, 5 Drawing Figures

METHOD OF HOT-FORMING METALS PRONE TO CRACK DURING ROLLING

BACKGROUND OF THE INVENTION

The present invention relates to the hot forming of metals, and more particularly relates to the continuous casting and hot forming of the as-cast bars of certain impure metals prone to crack during hot-rolling.

It is well known that many metals, such as copper, may be continuously cast, either in stationary vertical molds or in a rotating casting wheel, to obtain a cast bar which is then immediately hot formed, while in a substantially as-cast condition, by passing the cast bar exiting the mold to and through the roll stands of a rolling mill while the cast bar is still at a hot-forming temperature. It is also well known that the as-cast structure of the metal bar is such that cracking of the cast bar during hot forming may be a problem if the cast bar is required to be directly hot formed into a semi-finished product, such as redraw rod, during which the initially large cross-sectional area of the cast bar is substantially reduced by a plurality of deformations along different axes to provide a much smaller cross-sectional area in the product.

While this problem could be avoided by casting a cast bar having an initially small cross-sectional area which need not be substantially reduced to provide the desired cross-sectional area of the final product, this approach is not commercially practical since high casting outputs, and therefore low costs, can be readily achieved only with cast bars having large cross-sectional areas which are rapidly reduced to the smaller cross-sectional areas of the products, such as ⅜" diameter rod for drawing into wire, by a minimum number of severe deformations. Thus, the problem of a cast bar cracking during hot forming must be solved within the commercial context of cast bars having initially large cross-sectional areas which are then hot formed into products having small cross-sectional areas by a series of reductions which often are substantial enough to cause cracking of the cast bar under certain conditions.

This problem has been overcome in the prior art for relatively pure electrolytically-refined copper having low impurity levels such as 3–10 ppm lead, 1 ppm bismuth, and 1 ppm antimony. For example, U.S. Pat. No. 3,317,994, and U.S. Pat. No. 3,672,430 disclose that this cracking problem can be overcome by conditioning such relatively pure copper cast bar by initial large reductions (e.g. 36%) of the cross-sectional area in the initial roll stands sufficient to substantially destroy the as-cast structure of the cast bar. The additional reductions along different axes of deformation, which would cause cracking of the cast bar but for the initial destruction of the as-cast structure of the cast bar, may then safely be performed. This conditioning of the cast bar not only prevents cracking of the cast bar during hot forming but also has the advantage of accomplishing a large reduction in the cross-sectional area of the cast bar while its hot-forming temperature is such as to minimize the power required for the reduction.

The prior art has not, however, provided a solution to the cracking problem described above for metals, such as fire-refined copper, containing a high degree of impurities. This is because the large amount of impurities in the grain boundaries of the as-cast structure cause the cast bar to crack when an attempt is made to substantially destroy the as-cast structure with the same large initial reduction of the cross-sectional area of the cast bar that is known to be effective with low impurity metals. Moreover, the greater the percentage of impurities in the cast bar, the more likely it is that cracks will occur during hot forming.

Thus, although there is no requirement for high-purity electrolytically-refined copper (except for specialized uses such as magnet wire) it has heretofore been necessary to use such highly refined copper in order to be able to use and obtain the many advantages of tandem continuous casting and hot-forming apparatus. As a result, a substantial refining cost is added to the price of many final copper products even though high purity is not required to meet conductivity or other specifications. For example, fire-refined copper wire having a moderately high degree of impurities can meet the IACS conductivity standard for household electrical wiring and can be produced most economically if the rod to be drawn into such wire can be produced using known continuous casting and hot-forming apparatus.

SUMMARY OF THE INVENTION

The present invention solves the above-described cracking problem of the prior art by providing a method of continuously casting and hot forming both low and high impurity metal without substantial cracking of the cast bar occurring during the hot rolling process. Generally described, the invention provides, in a method of continuously casting molten metal to obtain a cast bar with a relatively large cross-sectional area, and hot forming the cast bar at a hot-forming temperature into a product having a relatively small cross-sectional area by a substantial reduction of the cross-sectional area of the cast bar which would be such that the as-cast structure of the cast bar would be expected to cause the cast bar to crack, the additional step of first forming a shell of finely distributed recrystallized grains at least in the surface layers of the cast bar prior to later substantial reduction of the cross-sectional area of the cast bar, said shell being formed by relatively slight deformations of the cast bar while at a hot-forming temperature.

The slight deformations are of magnitude (preferably 5 to 20%) which will not cause the cast bar to crack, but which in combination with the hot-forming temperature of the cast bar will cause the cast bar to have a shell of finely distributed recrystallized grains of a thickness sufficient (about 10% of total area) to prevent cracking of the cast bar (even when having moderately high impurities) during the subsequent substantial deformations. The surface shell of fine grains provided by the invention allows substantial reduction of the cross-sectional area of the bar in a subsequent pass, even in excess of 40%, without cracking occurring and even though the cast bar has a relatively high amount of impurities.

For example, the present invention allows a copper cast bar having a cross-sectional area of 5 square inches, or more, and containing as much as 50–200 ppm of impurities, such as lead, bismuth, iron and antimony, to be continuously hot formed into wrought copper rod having a cross-section area of ½ square inch, or less, without cracking.

Furthermore, the invention has wide general utility since it can also be used with certain over relatively impure metals as an alternative to the solution to the problem of cracking described in U.S. Pat. No. 3,317,994, and U.S. Pat. No. 3,672,430.

Thus, it is an object of the present invention to provide an improved method of continuously casting a molten metal to obtain a cast bar and continuously hot forming the cast bar into a product having a cross-sectional area substantially less than that of the cast bar without cracking of the cast bar occurring during hot forming.

It is further object of the present invention to provide a method of continuously casting and hot-forming metal containing a relatively high percentage of impurities without using specially shaped reduction rolls in the hot-rolling mill or other complex rolling procedures.

It is a further object of the present invention to provide a method whereby a cast bar may be efficiently hot-formed using fewer roll stands following conditioning of the cast metal by first forming a shell of finely distributed recrystallized grains at the surface of the cast metal, then hot rolling the modified structure by successive heavy deformations.

It is a further object of the present invention to provide a method for continuously casting and hot-forming fire-refined copper having in excess of 50 ppm impurities.

Further objects, features and advantages of the present invention will become apparent upon reading the following specification when taken in conjunction with the accompanying drawing.

DESCRIPTION OF THE PREFERRED EMBODIMENTS

Figure 1:
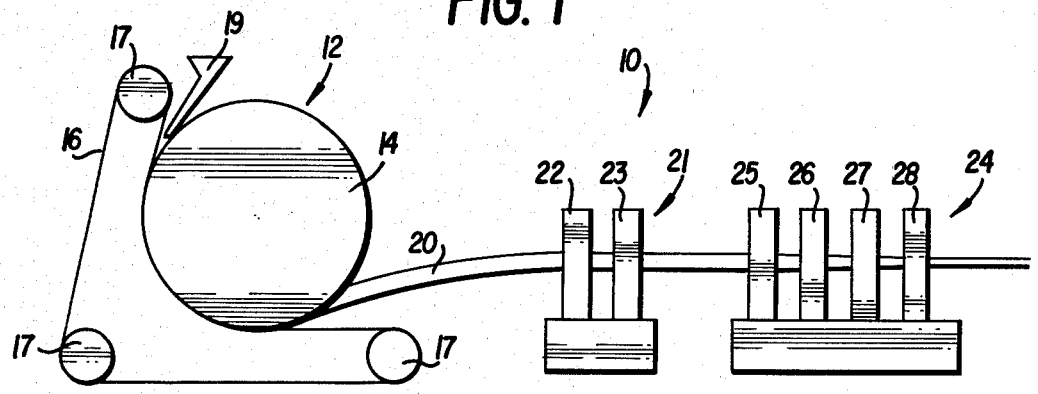
FIG. 1 is a schematic representation of casting and forming apparatus for practicing the method of the present invention.

Referring now to the drawing, in which like numerals refer to like parts throughout the several views, FIG. 1 schematically depicts an apparatus for practicing the method of the present invention. The continuous casting and hot-forming system (10) includes a casting machine (12) which includes a casting wheel (14) having a peripheral groove therein, a flexible band (16) carried by a plurality of guide wheels (17) which bias the flexible band (16) against the casting wheel (14) for a portion of the circumference of the casting wheel (14) to cover the peripheral groove and form a mold between the band (16) and the casting wheel (14). As molten metal is poured into the mold through the pouring spout (19), the casting wheel (14) is rotated and the band (16) moves with the casting wheel (14) to form a moving mold. A cooling system (not shown) within the casting machine (12) causes the molten metal to solidify in the mold and to exit the casting wheel (14) as a solid cast bar (20).

From the casting machine (12), the cast bar (20) passes through a conditioning means (21), which includes roll stands (22) and (23). The conditioning roll stands (22) and (23) lightly compress the bar which recrystallizes in the area compressed to form a shell of finely distributed grain structure at the surface of the bar (20). After conditioning, the bar (20) is passed through a conventional rolling mill (24), which includes a plurality of roll stands (25), (26), (27) and (28). The roll stands of the rolling mill (24) provide the primary hot forming of the cast bar by compressing the conditioned bar sequentially until the bar is reduced to a desired cross-sectional size and shape.

Figure 2:
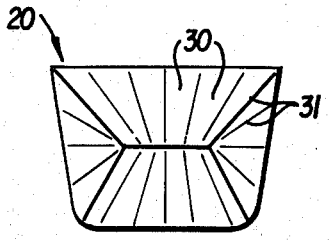
FIG. 2 is a cross-section of a cast bar in substantially an as-cast condition (in this case with columnar grains).

The grain structure of the cast bar (20) as it exits from the casting machine (12) is shown in FIG. 2. The molten metal solidifies in the casting machine in a fashion that can be columnar, or equiaxed, or both, depending on the cooling rate. This as-cast structure can be characterized by large grains (30) extending radially from the surfaces of the bar (if columnar) and separated from each other by grain boundaries (31). Most of the impurities present in the cast bar are located along the grain and dendrite boundaries (31). If the molten copper poured through the spout (19) into the casting wheel (14) were only fire-refined, and not electrolytically-refined, and the cast bar (20) was passed immediately to the rolling mill (24) without passing through the conditioning means (21), the impurities along the boundaries (31) of the cast bar (20) would cause the cast bar to crack at the boundaries upon deformation by the roll stands of the rolling mill (24) when following the teachings of the prior art as illustrated in U.S. Pat. No. 3,317,994.

Figure 3:
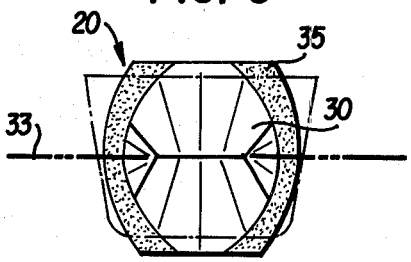
FIG. 3 is a cross-section of the cast bar shown in FIG. 2 following one slight reduction of the cross-section.
Figure 4:
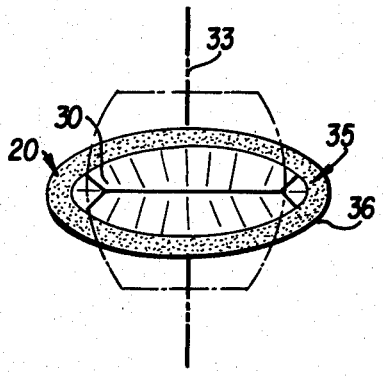
FIG. 4 is a cross-section of the cast bar shown in FIG. 2 following two perpendicular slight compressions to form a complete shell of finely distributed grains near the surface of the bar.

The conditioning means (21) of the present invention prevents such cracking by providing a sequence of preliminary light compressions as shown in FIG. 3 and FIG. 4, wherein the result of a compression is shown and the previous shape of the cast bar is shown in broken lines. FIG. 3 shows the result of a 7% reduction provided by the roll stand (22) along a horizontal axis of compression (33). The columnar and/or equiaxed as-cast grain structure of the cast metal has been recrystallized into a layer of equiaxed grains (35) covering a portion of the surface of the cast bar (20). The interior of the bar may still have an as-cast structure.

In FIG. 4 the bar (20) has been subjected to a second 7% reduction by the roll stand (23) along a vertical axis of compression (33) perpendicular to the axis of compression of roll stand (22). The volume of recrystallized finely distributed grains (35) now forms a shell (36) around the entire surface of the bar (20), although the interior of the bar retains some as-cast structure.

It will be understood that the formation of the shell may be accomplished by a conditioning means comprising any number of roll stands, preferably at least two, or any other type of forming tools, such as extrusion dies, multiple forging hammers, etc., so long as the preliminary light deformation of the metal results in a shell of recrystallized grains covering substantially the entire surface of the bar, or at least the areas subject to cracking when subject to the first heavy reduction.

The individual slight compressions should be between 5–20% reduction for example about 7% to 10%, so as not to crack the bar during conditioning. The total deformation provided by the conditioning means (21) must provide a shell (36) of sufficient depth (at least about 10%) to prevent cracking of the bar during subsequent severe deformation of the bar when passing through the roll stands (25-28) of the rolling mill (24).

When the shape of the bar in its as-cast condition includes prominent corners such as those of the bar shown in FIG. 2, the shape of the compressing surfaces in the roll stands (22) and (23) may be designed to avoid excessive compression of the corner areas as compared to the other surfaces of the cast bar, so that cracking will not result as the corners during conditioning.

Figure 5:
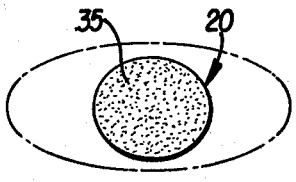
FIG. 5 is a cross-section of the cast bar shown in FIG. 2 following two slight compressions and one severe hot-forming compression.

FIG. 5 shows a cross-section of the cast bar (20) following a substantial reduction of the cross-sectional area by the first roll stand (25) of the rolling mill (24). The remaining as-cast structure in the interior of the bar (20) has been recrystallized to form finely distributed equiaxed grains (35).

When a shell (36) has been formed on the surface of the bar (20), a high reduction may be taken at the first roll stand (25) of the rolling mill (24). It has been found that such initial hot-forming compression may be in excess of 40% following conditioning according to the present invention. The ability to use very high reductions during subsequent hot-forming means that the desired final cross-sectional size and shape may be reached using a rolling mill having a few roll stands. Thus, even though a conditioning means according to the present invention requires one or two roll stands, the total amount and therefore cost of the conditioning and hot-forming apparatus may be reduced.

The method of the present invention allows continuous casting and rolling of high impurity metals, such as fire-refined copper generally including from 50 to 200 ppm lead, bismuth, iron and antimony without cracking the bar. Furthermore, cracking is prevented throughout the hot-forming temperature range of the metal. In addition, the method of the present invention is effective for processing electrolytically-refined copper as well. Thus, the same casting and hot-forming apparatus may be used to produce metals of varying purity depending on the standards which must be met for a particular product. It is not longer necessary to add the cost of additional refining to the cost of the final product when a highly pure product is not specifically required.

If it is desired to reduce even further the possibility of cracking, elliptically shaped rolling channels may be provided for all of the roll stands (22), (23), and (25–28) in order to provide optimal tangetial velocities of the rolls in the roll stands with respect to the cast metal, as disclosed in U.S. Pat. No. 3,317,994. However, such measures are usually not needed to avoid cracking if the present invention is practiced as described herein on metals having impurity levels as described above.

It will be understood by those skilled in the art that the roll stands of the conditioning means (21) may be either a separate component of the system or may be constructed as an integral part of a rolling mill.

While this invention has been described in detail with particular reference to preferred embodiments thereof, it will be understood that variations and modifications can be effected within the spirit and scope of the invention as described herein before and as defined in the appended claims.

What is claimed is:

1. A method for hot rolling, directly inline with a continuous caster, a continuous bar of high impurity copper without cracking said bar during heavy reduction from the predominately as cast condition, comprising:

(a) providing as a starting material, a molten flow of high impurity copper; then (b) continuously casting said molten flow into a continuous bar and directing the advancing solidified bar to an inline continuous hot rolling mill, said bar being in the as cast condition and at a hot-forming temperature; then (c) conditioning said bar immediately precedent to subjecting said bar to heavy reduction in said rolling mill, said conditioning being characterized in that said bar is preliminarily subjected to light reduction sufficient to cause recrystallization in a relatively thin surface shell within said bar but otherwise leaving said bar in a predominately as cast condition; and then (d) subjecting said bar to heavy reduction in at least the first roll stand following conditioning, said heavy reduction being sufficient to cause substantially complete recrystallization throughout the entire cross-section of said bar after conditioning.

2. The method of claim 1 wherein said high impurity copper contains at least about 50 ppm impurities.

3. The method of claim 2 wherein said impurities are in the range of about 50 to 200 ppm of one or more of the impurities lead, bismuth, iron, and antimony.

4. The method of claim 3 wherein the cross-sectional area of said surface shell resulting from step (c) constitutes about 10% of the cross-sectional area of said bar.

5. The method of claim 1, 2, 3, or 4 wherein the cumulative reduction of the bar cross-section during said conditioning is in the range of about 5 to 20%.

6. The method of claim 5 wherein said conditioning further comprises a first reduction of about 7% along a first axis of compression and a second reduction of about 7% along a second axis of compression being 90° removed from said first axis.

7. The method of claim 5 wherein said heavy reduction of step (d) is at least about 40%.

* * * * *